United States Patent [19]

Bourgeois

[11] 4,068,498

[45] Jan. 17, 1978

[54] INTERLOCKING CAMS

[75] Inventor: Norbert Bourgeois, Troyes, France

[73] Assignee: ASA S.A., Roanne, France

[21] Appl. No.: 586,881

[22] Filed: June 16, 1975

[30] Foreign Application Priority Data

Oct. 15, 1974 France ..... 74 34681

[51] Int. Cl.[2] ..... D04B 15/32

[52] U.S. Cl. ..... 66/57; 66/20

[58] Field of Search ..... 66/57, 20, 50 R, 25 R, 66/40, 38, 19, 42, 21, 22, 23, 54, 78

[56] References Cited

U.S. PATENT DOCUMENTS

| | | | |
|---|---|---|---|
| 1,388,781 | 8/1921 | Stibbe | 66/19 X |
| 2,968,170 | 1/1961 | Wiesinger | 66/20 |
| 3,108,459 | 10/1963 | Coile | 66/57 X |
| 3,387,466 | 6/1968 | Beckenstein | 66/57 |
| 3,405,542 | 10/1968 | Beckenstein | 66/57 |
| 3,490,252 | 1/1970 | Paepke et al. | 66/57 |
| 3,572,056 | 3/1971 | Radin | 66/57 |
| 3,670,526 | 6/1972 | Martinetz | 66/57 |
| 3,709,004 | 1/1973 | Paepke | 66/57 |
| 3,795,119 | 3/1974 | Bourgeois | 66/57 |
| 3,800,561 | 4/1974 | Beuter et al. | 66/57 |

FOREIGN PATENT DOCUMENTS

| | | | |
|---|---|---|---|
| 1,263,321 | 5/1961 | France | 66/57 |

*Primary Examiner*—Mervin Stein
*Assistant Examiner*—Andrew M. Falik
*Attorney, Agent, or Firm*—Jones, Thomas & Askew

[57] ABSTRACT

The circular knitting machine comprises at least one sinking cam and one movable cam enabling a selection of knitting elements to occupy several positions. The sinking cam is rotatably biased into a working position in which its working ramp cooperates with the butts of the knitting elements selected for knitting and can be moved to a rest position in which the working ramp cooperates with the knitting elements which are welting. The sinking cam is held in its rest position by a surface thereon which engageingly cooperates with a locking means on the movable cam when the movable cam is in a position to cause the knitting elements to welt.

1 Claim, 4 Drawing Figures

Fig_1
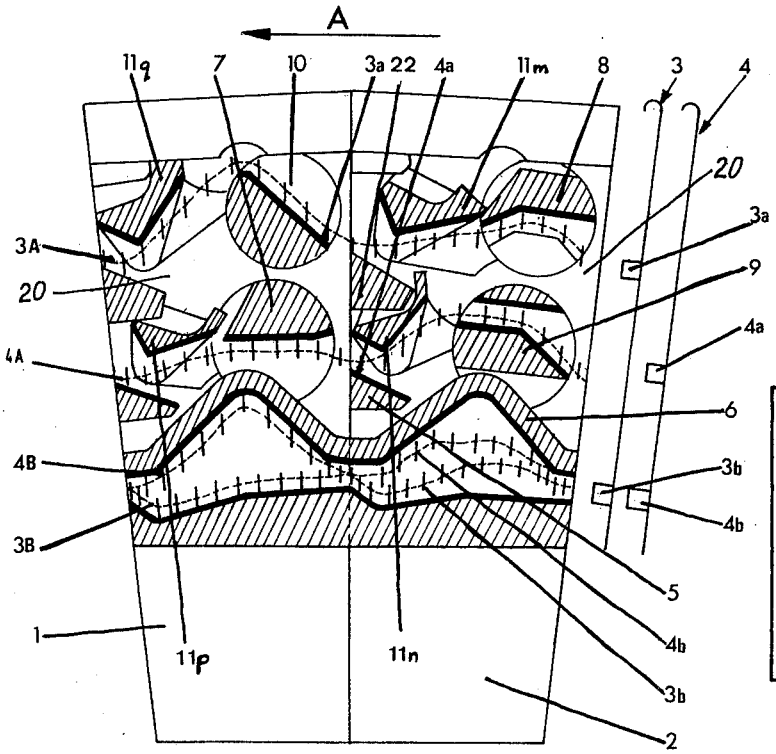
Fig_4
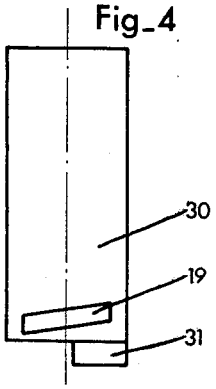
Fig_2
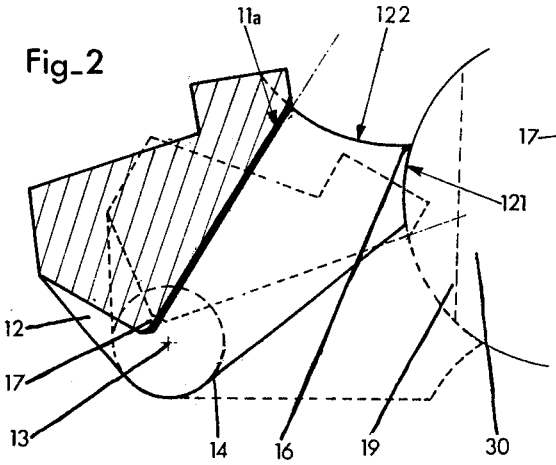
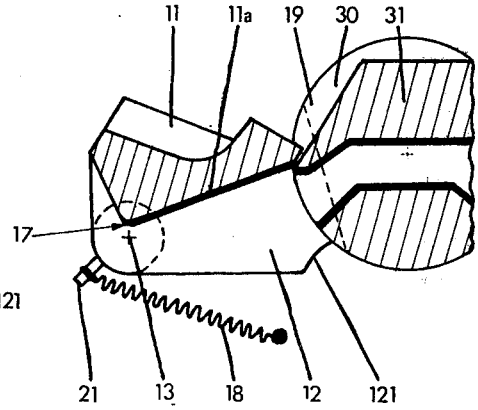
Fig_3

INTERLOCKING CAMS

The present invention relates to a circular knitting machine comprisng at least one sinking cam and a cam movable through a cam path enabling preselection of knitting elements such as the needles, for several positions of which some correspond with the looping.

In known circular knitting machines, the needles controlled by a movable cam so as not to participate in the forming of stitches strike harshly against the most acute angle of the sinking cam. This impact creates a shock wave which is propagated along the shaft of the needle up to the hook; after some time the repetition of these shocks damages the needle hooks.

In accordance with a known answer to the problem, there is located in each cam path a protective cam having a ramp with a gentle slope which controls the non-knitting needles, before the butt encounters the working ramp of the sinking cam. The shock of the butt on the acute angle of the sinking cam is thus avoided. The profile of the protective cams is such that the ramp with the gentle slope guides the needles until their butt has passed below and beyond the acute angle of the sinking cam. Unfortunately, the longitudinal displacement of the needle brings about overstretching of the loop carried by this needle; this overstretching may even lead to breakage of the yarn in the event that the machine is knitting with fragile yarns.

The disadvantage of this answer to the problem is that it requires additional cams which impose on the loops carried by the non-working needles a distortion which may itself also bring about breakage of the yarn.

The object of the present invention is to remedy these disadvantages and the intention is to provide a circular knitting machine enabling shocks on the needles to be avoided in order to increase needle lifetime. Undesirable needle operation which results in excessive loop stretching and in some cases yarn breakage is also remedied by the instant invention.

To this end, the present invention relates to a circular knitting machine of the above type characterised in that each cam path includes at least one sinking cam capable of occupying either a working position in which the working ramp of the cam co-operates with the butts of knitting elements selected for the looping, or a rest position in which the working ramp co-operates with the knitting elements which do not participate in the looping.

Thanks to this sinking cam capable of occupying a rest position and a working position, on the one hand there is no sudden shock to the butts of the needles which are not participating in the knitting and, on the other hand, those needles which are not participating in the knitting do not carry out an over-long movement, thus doing away with all risks of breakage of the yarns, especially when the knitting is carried out with a fragile yarn.

According to another characteristic of the invention, the sinking cam includes stoppage means in the working position, when the cam co-operates with the movable cam selecting the knitting elements for the looping, or knitting, and the sinking cam and movable cam include locking means when the movable cam selects the knitting elements, in a position which does not participate in the looping i.e., that is wetting. This means prevents any accidental change in the cam position during operation of the knitting machine.

The present invention will be described in more detail with reference to the accompanying drawings, in which:

FIG. 1 is a schematic plan view of part of a dial of a circular knitting machine showing the cams of two consecutive knitting feeds;

FIG. 2 is a schematic view from above showing, in full lines, the sinking cam in the working position and, in dotted lines, the sinking cam in the rest position;

FIG. 3 is a schematic view of the sinking cam and a removable cam;

FIG. 4 is a front view of one example of removable cam.

According to FIG. 1, two consecutive knitting feeds 1, 2 of the dial of a circular knitting machine, not shown in full are furnished with long needles 3 and short needles 4, shown by way of example at the right-hand part of FIG. 1.

Each needle 3, 4 includes respectively, an upper butt *3a, 4a* and a lower butt *3b, 4b*.

The butts *3a, 3b, 4a, 4b* of the various needles have been shown in the respective needle races. The needles 3, 4 and the butts travel in the direction of the arrow A, in relation to the set of cams defining the feeds of the butts, as will be described in detail hereinafter. However, it is also possible not to involve rotation of the needles, so that they perform a radial movement, the cams then travelling in the direction opposite to the direction A.

The various cam paths followed by the butts *3a, 3b,* and *4a, 4b* are represented by the broken lines referenced 3A, 3B, 4A, 4B.

Each knitting feed 1, 2 includes a fixed number of cams defining the radial position of the needles co-operating with the butts of the latter. The cam paths of the long needles 3 and of the short needles 4 are fundamentally the same in the sense that they are defined by cams of the same type having identical actions on the needles with which they co-operate.

More precisely, there is a set of cams carried by the supports 20 of the knitting feeds 1 and 2. The cams shown are the following:

- the sinking counter cam 5,
- the cams 6 for guiding the lower butts *3b, 4b* of the needles 3, 4,
- the cam 7 determining the path of the idling movement of the needles,
- the guard cam 8,
- the upthrow cam 9,
- the raising cam 10,
- the sinking cams *11m, 11n, 11p, 11q*.

The paths 3A, 4A, 4B, 3B of the butts *3a, 4a, 4b, 3b* of the needles 3, 4 are defined as follows.

The path 3A is formed successively by the cams **8, 11*m*, 10, 11*q***.

The path 4A is defined successively by the cams **9, 11*n*, 5, 7, 11*q*, 5**.

The paths 3B and 4B are defined by the cam 6.

According to FIG. 1, the sinking cams *11m, 11n, 11p, 11q* are of substantially similar shape and they are movable. The description given hereinafter relates to such sinking cams 11.

According to FIG. 2, the sinking cam 11, with working surface *11a*, form a one-piece body with a base 12 serving as support, and provide for the pivoting of the cam 11 about the axis 13 to take it from the working position, shown in full lines, to the rest position, shown in broken lines.

The support 12 is provided with two stopping surfaces 121 and 122 each having a curved shape suitable for application against the cylindrical surface of the support 30 of the removable or interchangeable cam 31. The cam 31 is selected in a set of interchangeable cams, each defining one position of the knitting elements.

When the cam 11 is in working position, the curved surface 121 is applied against the cylindrical support 30; when the cam 11 is in rest position, the curved surface 122 of the support 12 comes against the cylindrical surface of the support 30 of the removable cam.

According to one embodiment, the cam 11 and the support 12 form a one-piece body. However, it is possible to provide these two elements as two different pieces connected to one another in accordance with standard means in mechanical construction.

The control of the cam 11 to take it from the working position to the idling position or inversely is insured by manual control means, bound up with the rod 14, coaxial with the axis 13.

In the rest position the cam 11 comes against a stop 22 (FIG. 1).

When the cam 11 pivots from one position to the other, the cusp 16 formed by the junction of the two curved surfaces 121 and 122 of the support 12 passes into a groove 19 formed in the support 30 of the cam 31.

This in turn rotates the support 30 which in turn locks the cam 11 in its rest position. The inclined form (for example helical) of the groove 19 enables same to arrest the cusp 16 while avoiding any play between the cusp 16 and the groove 19.

The lower point of the working surface 11*a* of the cam 11 moves outwardly of the dial of the circular knitting machine. The needles not selected for the knitting which are controlled by the working ramp 11*a* of the cam 11, disposed in the inactive position or rest position, escape from this cam before reaching the position occupied by the point 17 when the cam 11 is in working position. As a result the loop carried by the needles which are knitting is not stretched; this removes any risk of breakage of the yarn even when knitting with fragile yarns.

FIG. 3 shows the cam 11 in the position of rest with respect to the cam 31.

The rod 14 which carries the cam support 12 is furnished with a lug 21 to which is anchored a release spring 18.

In this way, each time the cam 31 is withdrawn, the unlocked cam 11 is brought back to the working position against the stop 22 by the spring 18. The second end of the spring 18 is anchored to a fixed point integral with the support 20 of the knitting feed.

FIG. 4 shows a front view of the support 30 of a movable cam, for example 31, showing the oblique slot 19.

When the sinking cam 11 co-operates with an upthrow cam 9 or a raising cam 10, this cam 11 cannot pass into its rest position, as the cylindrical part of the support of the cam 9 or 10 does not include an oblique groove 19 in which the cusp 16 of the support 12 could be engaged.

Thus, the sinking cam 11 can occupy only two specific positions:

1. An active position in which it is supported on the stop 22 while being maintained on this stop by the release spring 18; or 2. A rest position in which it is located by the engagement of the cusp 16 in the groove 19 of the movable cam 9, 10 with which it co-operates.

The present invention is applicable to various types of removable cams, either by the outside, for example interchangeable cams necessitating the disassembling of the knitting section, or survel cams, for example with three positions: knit, tuck and miss, or bolt cams, etc.

Of course, the invention is not restricted to the embodiments described above and shown, from which other forms and other embodiments can be provided without thereby departing from the scope of the invention.

What is claimed is:

1. A circular knitting machine comprising at least one sinking cam and one movable cam enabling a selection of knitting elements to occupy several positions wherein said sinking cam is rotatably biased into a working position in which its working ramp cooperates with the butts of the knitting elements selected for knitting and can be moved to a rest position in which the working ramp cooperates with the knitting elements which are welting, said sinking cam being held in said rest position by a surface thereon which engagingly cooperates with a locking means on said movable cam when the latter is in a position to cause the knitting elements to welt.

* * * * *